US012674285B2

(12) United States Patent
Gooden

(10) Patent No.: US 12,674,285 B2
(45) Date of Patent: Jul. 7, 2026

(54) FORMWORK, MATRICES, CONCRETE MATRICES AND METHODS OF MANUFACTURE

(71) Applicant: STRATA INNOVATIONS PTY LIMITED, Singleton (AU)

(72) Inventor: Benjamin Douglas Gooden, Singleton (AU)

(73) Assignee: STRATA INNOVATIONS PTY LIMITED, Singleton (AU)

( * ) Notice: Subject to any disclaimer, the term of this patent is extended or adjusted under 35 U.S.C. 154(b) by 0 days.

(21) Appl. No.: 18/233,345

(22) Filed: Aug. 14, 2023

(65) Prior Publication Data

US 2025/0059714 A1 Feb. 20, 2025

(51) Int. Cl.
*E01C 3/00* (2006.01)
*E03F 1/00* (2006.01)

(52) U.S. Cl.
CPC ..... *E01C 3/00* (2013.01); *E03F 1/002* (2013.01)

(58) Field of Classification Search
CPC ..... E01C 3/006; E01C 9/002; E03F 1/005
USPC ..... 404/28
See application file for complete search history.

(56) References Cited

U.S. PATENT DOCUMENTS 1,473,639 A * 11/1923 Page ..... E01C 3/006 52/604
2,327,640 A 8/1943 Hendry
2,375,454 A 5/1945 Wichert
2,394,713 A 2/1946 Harold
3,557,669 A 1/1971 Fenton
3,802,790 A 4/1974 Blackburn
4,372,014 A * 2/1983 Simpson ..... E04D 3/352 24/584.1
4,478,901 A 10/1984 Dickens
5,123,778 A 6/1992 Bohnhoff
5,460,867 A 10/1995 Magnuson
5,848,856 A 12/1998 Bohnhoff
6,428,870 B1 8/2002 Bohnhoff
(Continued)

FOREIGN PATENT DOCUMENTS

AU 2014246660 A1 10/2015
AU 2018363887 A1 5/2020
(Continued)

*Primary Examiner* — Christopher J Sebesta
*Assistant Examiner* — Katherine J Chu
(74) *Attorney, Agent, or Firm* — William H. Honaker; Dickinson Wright PLLC

(57) ABSTRACT

Formwork, matrices, concrete matrices and methods of manufacture are described. The formwork may be configured to receive and retain concrete within an internal void space and has a concrete free external void space. Also described is a concrete matrix formed using the formwork and related methods of manufacture of a formwork matrix and formwork. The formwork itself and matrices formed from the formwork may have a degree of compressive strength. With concrete poured and set into the formwork, the resulting concrete matrix has a very high compressive strength and forms a structural matrix on which a hardscape or load may be placed. The above formwork, matrices, and methods reduces the number of parts needed to form a formwork or matrix and may facilitate snap fit design and installation and hence the ability to assemble the matrix toolessly.

27 Claims, 19 Drawing Sheets

(56) References Cited

U.S. PATENT DOCUMENTS

| | | | | |
|---|---|---|---|---|
| 6,585,449 | B2 * | 7/2003 | Chen | E01C 11/226 404/36 |
| 6,962,464 | B1 | 11/2005 | Chen | |
| 7,201,538 | B2 | 4/2007 | Blackwood | |
| 7,704,011 | B2 | 4/2010 | Marshall | |
| 7,771,814 | B2 | 8/2010 | Grimble | |
| 8,267,618 | B2 | 9/2012 | Chen | |
| 8,353,640 | B2 | 1/2013 | Sawyer | |
| 8,555,586 | B2 | 10/2013 | Lowe | |
| 8,596,903 | B2 | 12/2013 | Hur | |
| 8,608,401 | B2 | 12/2013 | Gooden | |
| 8,683,769 | B2 | 4/2014 | Cerny | |
| 8,696,241 | B2 | 4/2014 | Lee | |
| 9,303,365 | B2 | 4/2016 | Gooden | |
| 9,506,235 | B2 | 11/2016 | Adams | |
| 9,775,303 | B2 | 10/2017 | Ray | |
| 9,775,304 | B2 | 10/2017 | Gooden | |
| 10,415,260 | B2 * | 9/2019 | Gooden | E01C 11/185 |
| 10,557,247 | B2 * | 2/2020 | Earhart | E04H 17/08 |
| 11,761,152 | B2 * | 9/2023 | Ray | E01C 9/005 404/28 |
| 2005/0117969 | A1 | 6/2005 | Byrne | |
| 2008/0113161 | A1 | 5/2008 | Grimble | |
| 2008/0115413 | A1 | 5/2008 | Blackmore | |
| 2008/0166182 | A1 | 7/2008 | Smith | |
| 2009/0145072 | A1 * | 6/2009 | Li | E01F 8/023 52/652.1 |
| 2009/0242731 | A1 | 10/2009 | Dinkins | |
| 2009/0250369 | A1 | 10/2009 | Guibert | |
| 2010/0260546 | A1 | 10/2010 | Blackwood | |
| 2011/0097151 | A1 | 4/2011 | Lee | |
| 2012/0020746 | A1 * | 1/2012 | Astolfi | E02D 29/025 52/604 |
| 2012/0057932 | A1 | 3/2012 | Marshall | |
| 2012/0141203 | A1 | 6/2012 | Gooden | |
| 2012/0163911 | A1 | 6/2012 | Culleton | |
| 2012/0255624 | A1 | 10/2012 | Canney et al. | |
| 2014/0270945 | A1 | 9/2014 | Bach | |
| 2014/0369757 | A1 | 12/2014 | Meincke | |
| 2015/0016874 | A1 | 1/2015 | Wandkowski | |
| 2021/0148105 | A1 | 5/2021 | Zarraonandia | |
| 2021/0164172 | A1 * | 6/2021 | Dawson | E01C 3/006 |
| 2023/0116524 | A1 * | 4/2023 | Miller | E03F 1/005 405/36 |

FOREIGN PATENT DOCUMENTS

| | | | | |
|---|---|---|---|---|
| CN | 215668811 | U | 1/2022 | |
| EP | 1416099 | A2 | 5/2004 | |
| EP | 2682534 | A1 * | 1/2014 | E03F 1/005 |
| FR | 2642772 | A1 | 8/1990 | |
| KR | 101043285 | B1 | 6/2011 | |
| WO | 2010095155 | A1 | 8/2010 | |

* cited by examiner

FORMWORK, MATRICES, CONCRETE MATRICES AND METHODS OF MANUFACTURE

TECHNICAL FIELD

Described herein is formwork, matrices, concrete matrices and methods of manufacture. More specifically, a formwork is described configured to receive and retain concrete within an internal void space and which has a concrete free external void space. Matrices are described formed from the formwork. Also described is a concrete matrix formed using the formwork and related methods of manufacture of a formwork matrix and concrete matrix.

BACKGROUND ART

Structural cells may be provided for under hardscapes that support a compressive load. Art products are typically plastic mouldings using spaced apart legs and a base, top or other restraining structure to align the legs. The legs take up compressive loading on the structural cell allowing the void space inside the structural cell to be used for applications such as tree root growth in uncompacted soil or, water reservoir use where the void space is used to capture and retain storm water.

There can also be other uses for structural cells or matrices using the structural cells where void space is needed in order to fill a volume and, where some degree of structural strength and integrity is required. One example might be in the construction of roadside berms where structural cell matrices may provide an alternative to transporting and delivery of significant volumes of infill.

One drawback of existing designs may be complexity. Another drawback may be in cost. A further drawback may be in structural strength achieved from plastic. Another drawback may be a perceived lack of structural capability in civil and structural applications from a material like plastic. A further drawback may be that of plastic deflection whereby plastic art cells may move elastically when placed under load which is an issue when brittle or non-elastic materials are coupled with the cells and matrices.

WO2019/090397A1 presents one solution to the above describing a formwork used to form a matrix through which concrete may be poured and retained. The concrete sets to the matrix shape defined by the formwork. Concrete is a well-known and understood structural material hence, the formwork and resulting concrete cell provides an alternative means of providing a void space below a hardscape. The described formwork does however require multiple parts e.g. free sockets and separate plates leading to higher manufacturing cost and potentially slower assembly. Coupling cells is also reliant on separate parts like the described sockets or separate plates.

The formwork, matrices, concrete matrices and methods of manufacture described herein attempt to address at least some of the above drawbacks or at least provide the public with a choice.

Further aspects and advantages of the formwork, matrices, concrete matrices and methods of manufacture will become apparent from the ensuing description that is given by way of example only.

SUMMARY

Formwork, matrices, concrete matrices and methods of manufacture are described. The formwork may be configured to receive and retain concrete within an internal void space and has a concrete free external void space. Also described is a concrete matrix formed using the formwork and related methods of manufacture of a formwork matrix and formwork. The formwork itself and matrices formed from the formwork may have a degree of compressive strength. With concrete poured and set into the formwork, the resulting concrete matrix has a very high compressive strength and forms a structural matrix on which a hardscape or load may be placed.

In a first aspect, there is provided a formwork configured to receive and retain concrete therein, the formwork may include a frame having lateral supports, each lateral support defining a volume within the lateral support, the volume defined by a base, sides and an at least partially open top. The formwork may further include at least four legs, each leg having a tapering wall structure defining a hollow interior. The formwork may further include a first end and a second end, both the first end and the second end opening to the hollow interior. The formwork may also include the leg first end having a first diameter opening tapering to a second diameter opening about the second terminal end, the first diameter opening being larger than the second diameter opening. The formwork may further include the legs connecting to the frame at the first end of each leg, the legs extending orthogonally away from the frame to the second ends of the legs. The formwork may include a vertical coupling, the vertical coupling may be configured to couple with a further vertical coupling located on a second end of a leg from a further formwork. The formwork may furthermore include the frame coupling the first end of the legs together via the lateral supports. The formwork may also define an external void space outside of the frame lateral supports and legs and an internal void space located inside the hollow interior of the legs and the volume within the lateral supports, the internal void space configured to receive concrete therein.

In a second aspect, there is provided a matrix including a plurality of formwork substantially as described above. The matrix may be aligned vertically with each said frame of the formwork alternating in orientation from a first matrix layer of the formwork in a frame located below the plurality of legs configuration to a second layer of the formwork in a frame located above the plurality of legs configuration. The matrix may further include the vertical coupling of each formwork coupling to the first matrix layer of formwork with the second matrix layer of further formwork.

In a third aspect, there is provided a concrete matrix which may include a plurality of formwork substantially as described above and concrete within the internal void space of the formwork in the matrix.

In a fourth aspect, there is provided a method of forming a matrix which may include pouring concrete therein, by selecting a plurality of formwork substantially as described above. The method may further include forming a first matrix layer by placing, on a substrate, multiple formwork, the multiple formwork orientated in a configuration with the formwork frame located below the second ends of the legs. The method may also include forming a second matrix layer, over the first matrix layer, by vertically coupling the second ends of the legs of each formwork in the second matrix layer to the second ends of the legs in the first matrix layer, the formwork of the second matrix layer orientated in a configuration with the formwork frame located above the second ends of the legs.

In a fifth aspect, there is provided a method of forming a concrete matrix which may include selecting a plurality of formwork substantially as described above and forming a first matrix layer by placing, on a substrate, multiple formwork, the multiple formwork orientated in a configuration with the formwork frame located below the second ends of the legs. The method may also include forming a second matrix layer, over the first matrix layer, by vertically coupling the second ends of the legs of each formwork in the second matrix layer to the second ends of the legs in the first matrix layer, the formwork of the second matrix layer orientated in a configuration with the formwork frame located above the second ends of the legs. The method may furthermore include pouring concrete into the internal volume of the plurality of formwork and allowing the poured concrete to cure and harden in the internal void space of the plurality of formwork.

The formwork itself and matrices formed from the formwork may have a degree of compressive strength. With concrete poured and set into the formwork, the resulting concrete matrix has a very high compressive strength and form a structural matrix on which a hardscape or load may be placed.

BRIEF DESCRIPTION OF THE DRAWINGS

Further aspects of the formwork, matrices, concrete matrices and methods of manufacture will become apparent from the following description that is given by way of example only and with reference to the accompanying drawings in which.

DETAILED DESCRIPTION

Figure 1:
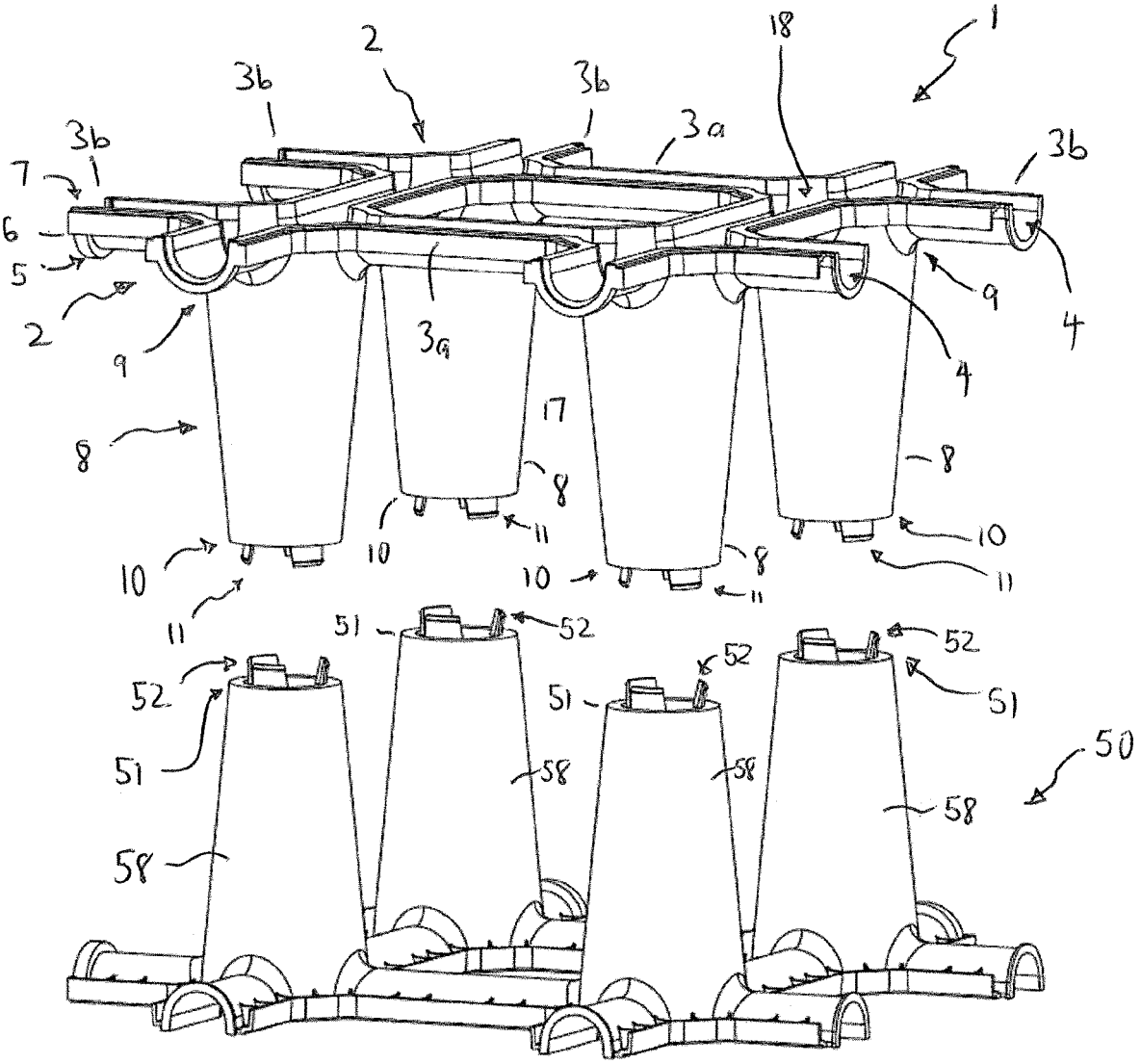
FIG. 1 illustrates an exploded perspective view of a first and further formwork.
Figure 2:
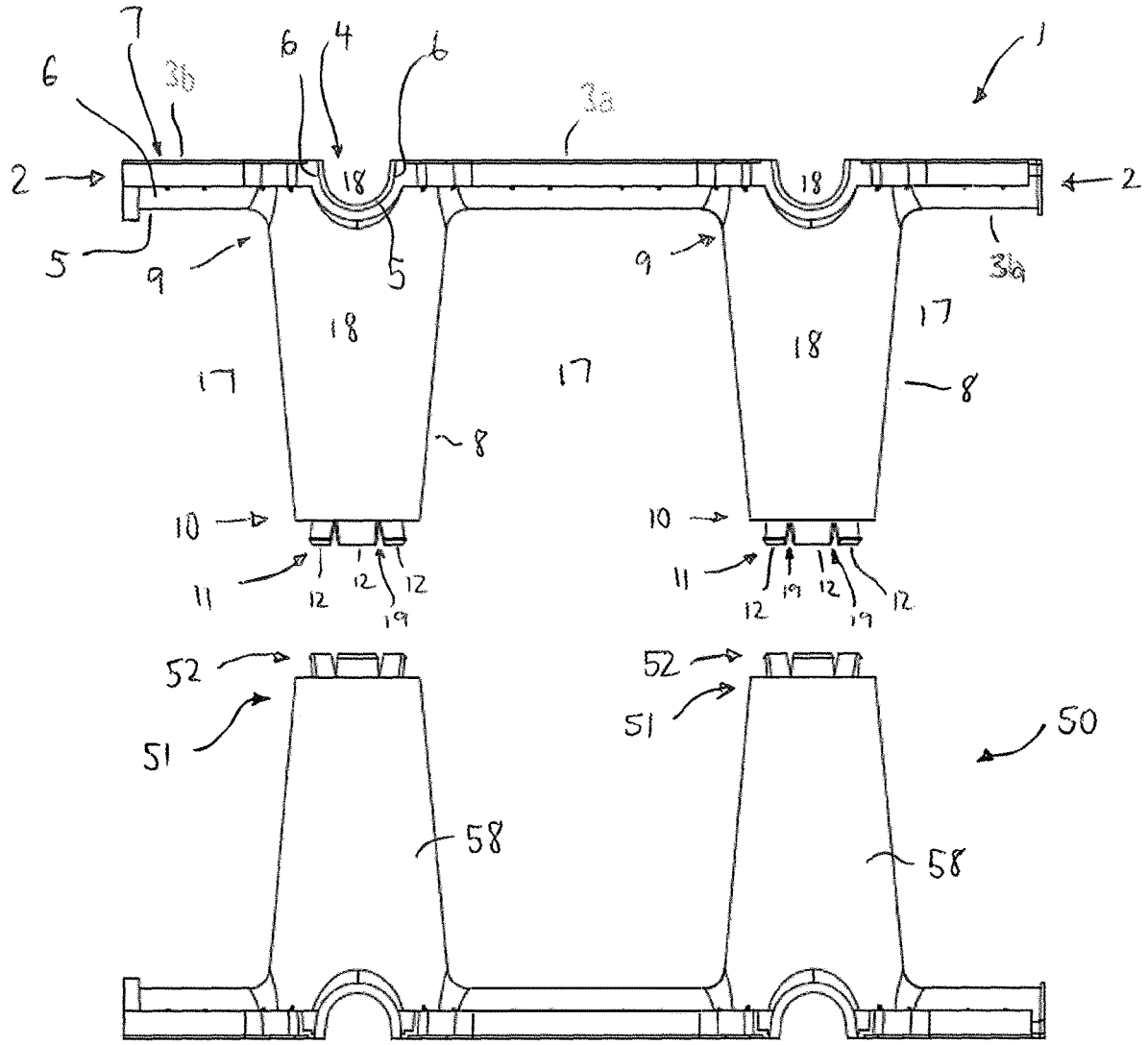
FIG. 2 illustrates an exploded front elevation view of a first and further formwork.
Figure 3:
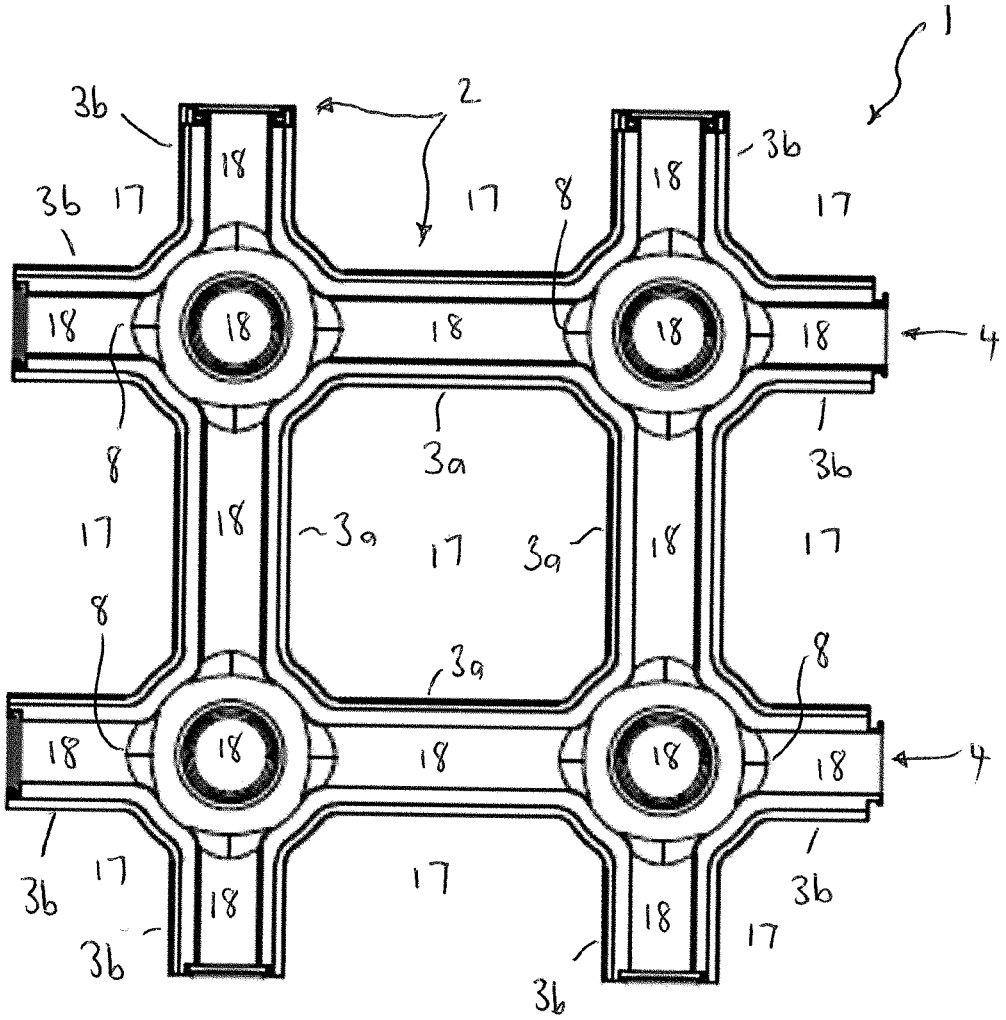
FIG. 3 illustrates a plan elevation view of a first and further formwork coupled together in a vertical plane.
Figure 4:
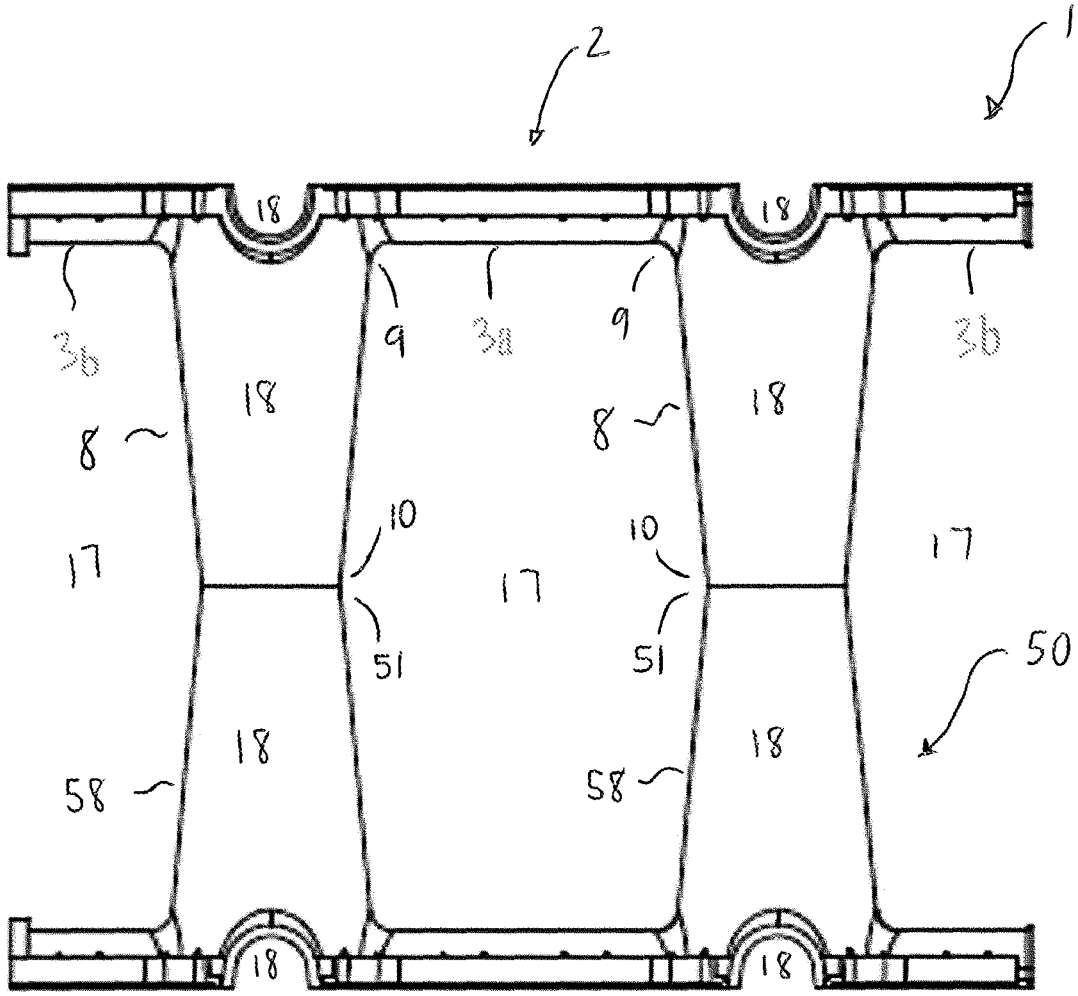
FIG. 4 illustrates a front elevation view of a first and further formwork coupled together in a vertical plane.
Figure 5:
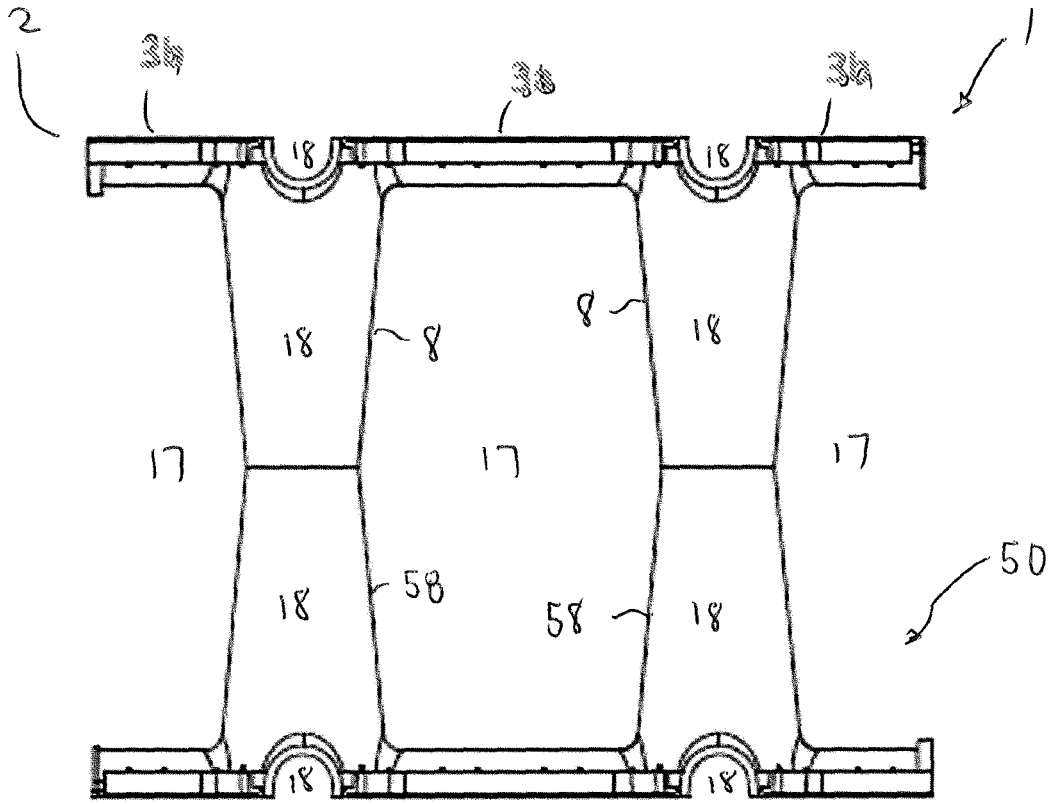
FIG. 5 illustrates a side elevation view of a first and further formwork coupled together in a vertical plane.

As noted above, formwork, matrices, concrete matrices and methods of manufacture are described. The formwork may be configured to receive and retain concrete within an internal void space and has a concrete free external void space. Also described is a concrete matrix formed using the formwork and related methods of manufacture of a formwork matrix and formwork. The formwork itself and matrices formed from the formwork may have a degree of compressive strength. With concrete poured and set into the formwork, the resulting concrete matrix has a very high compressive strength and forms a structural matrix on which a hardscape or load may be placed.

For the purposes of this specification, the term 'about' or 'approximately' and grammatical variations thereof mean a quantity, level, degree, value, number, frequency, percentage, dimension, size, amount, weight or length that varies by as much as 30, 25, 20, 15, 10, 9, 8, 7, 6, 5, 4, 3, 2, or 1% to a reference quantity, level, degree, value, number, frequency, percentage, dimension, size, amount, weight or length.

The term 'substantially' or grammatical variations thereof refers to at least about 50%, for example 75%, 85%, 95% or 98%.

The term 'comprise' and grammatical variations thereof shall have an inclusive meaning—i.e. that it will be taken to mean an inclusion of not only the listed components it directly references, but also other non-specified components or elements.

Formwork

In a first aspect, there is provided a formwork configured to receive and retain concrete therein, the formwork may include a frame comprising lateral supports, each lateral support defining a volume within the lateral support, the volume defined by a base, sides and an at least partially open top. The formwork may further include at least four legs, each leg comprising a tapering wall structure defining a hollow interior, a first end and a second end, both the first end and the second end opening to the hollow interior. The formwork may also include the leg first end having a first diameter opening tapering to a second diameter opening about the second terminal end, the first diameter opening being larger than the second diameter opening. The formwork may further include the legs connected to the frame at the first end of each leg, the legs extending orthogonally away from the frame to the second ends of the legs. The formwork may also include the second end of the legs comprising a vertical coupling, the vertical coupling configured to couple with a further vertical coupling located on a second end of a leg from a further formwork. The formwork may further include the frame coupling the first end of the legs together via the lateral supports. The formwork may define an external void space outside of the frame lateral supports and legs and, an internal void space located inside the hollow interior of the legs and the volume within the lateral supports, the internal void space configured to receive concrete therein.

Formwork Use

As noted above, the formwork may be configured to receive and retain concrete therein. The formwork design such as the shape the lateral supports and the legs may describe an internal void space as described that may receive concrete therein.

In one example, the formwork may be used without concrete. That is, the formwork or matrices formed using the described formwork may be used alone without concrete to support a hardscape or structure thereon. Soil may be placed in the external void space e.g. uncompacted soil for tree growth. Soil or other particulate materials may be placed in the internal void space instead of concrete. The internal and external void spaces of the formwork may be left empty with a structure on the top of the formwork. In view of these alternative uses, the use of the formwork to receive and retain concrete in the internal void space should not be seen as limiting.

Size and Shape

The formwork may define a generally cuboid volume. The formwork frame may define a generally square cross-section shape in a horizontal plane. The lateral supports may extend orthogonally from the leg in four directions spaced at 90 degrees to each other.

The formwork may comprise four legs.

The formwork may have a height from 5 to 30 inches.

The plurality of legs may be arranged relative to each other to collectively spread a compressive load placed thereon.

The diameter of the first end of the leg may be at least 85 mm and the diameter of the second end of the leg may be at least 80 mm Lateral Supports Each lateral support may have a generally U-shaped cross-section in a vertical plane formed by the lateral support base and sides and open top.

The formwork may comprise internal and external lateral supports. The internal lateral supports may extend from one leg first end to another leg first end. The external lateral supports may extend partly from a leg first end outside an envelope defined by the legs and internal lateral supports. The external lateral supports may extend coincident with the orientation of the internal lateral supports. The external lateral support length may be substantially half that of the length of an internal lateral support.

Vertical Coupling

The vertical coupling may comprise elongated tabs extending from the second end of the legs. The elongated tabs may be configured to nest and snug fit into a second end of a leg of a further formwork.

Each elongated tab may be generally flat and shaped to nest with the interior wall or a part thereof of the further formwork leg second terminal end.

The vertical coupling may comprise empty regions where no elongated tabs are present. The empty regions may be located intermediate the elongated tabs. The empty regions may be configured to receive elongated tabs from a second end of a leg of a further formwork.

The elongated tabs may act as a male coupling fitting into the leg terminal end which may act as a female portion of the coupling.

The coupling may be configured to provide a smooth interior face between the leg terminal ends so as to facilitate concrete flow from one leg to a further leg.

The second end of the legs may comprise a return shape forming a hook cross section shape. The elongated tab may comprise a resilient member. When the formwork and the further formwork are coupled together vertically via the second ends of the legs, the resilient member may snap fit over the return shape of the second end of the legs to couple the formwork and further formwork together.

Horizontal Coupling

Each of the lateral supports may comprise a horizontal coupling. The horizontal coupling may be configured to couple together one formwork lateral support to a further formwork lateral support. Horizontal coupling may be about a horizontal plane.

The frame may comprise internal lateral supports between the legs. The frame may comprise external lateral supports extending from the legs. The internal lateral supports may be of a uniform length and link each of the legs together. The external lateral supports may be of a uniform length. The external lateral supports uniform length may be substantially half the length of the internal lateral supports. The external lateral supports may extend from the legs in a direction parallel to and coincident with, the direction of an adjoining internal lateral support.

Each external lateral support may comprise a first end about the formwork leg first end and a second end distal to the first end of the leg.

The second end of each external lateral support may comprise a horizontal coupling. The horizontal coupling may be configured to allow the formwork and a further formwork to be coupled together in a horizontal alignment.

The second end of each external lateral support may comprise a male or a female fitting.

The external lateral support ends of a formwork may comprise alternating male and female fittings on each side of a formwork. These fittings may be configured to allow alternating formwork coupling about a horizontal plane.

Grill or Blank

The first end of the leg may be configured to receive a grill or a blank over the opening to the hollow interior of the leg.

The leg first frame end may comprise a recess and shoulder adapted to nestingly receive a grill or blank therein.

The lateral supports may comprise a recess and shoulder adapted to also nestingly receive part of a grill or blank therein.

The grills may connect to/interact with the legs and lateral supports.

Internal Void Space

The internal void space may be continuous and not segmented.

The internal void space may be formed as one integral moulded volume. The legs and lateral supports may be integral and may not be separate parts. The legs and lateral supports are moulded together.

Volume Split

The free void space may comprise 75-90% of a volume of the formwork.

The internal void space may comprise 1-25% of the volume of said formwork.

The balance of the volume of a formwork may be the volume of the frame or plurality of legs themselves.

Strength

The formwork without concrete located in the formwork, may have a compression strength in excess of 100 kPa.

Without concrete therein, the formwork may resist elastic deformation up to a point 5-20% below a final compressive strength of the formwork when plastic deformation occurs.

Matrix

In a second aspect, there is provided a matrix which may include a plurality of formwork substantially as described above. The matrix may be aligned vertically with each said frame of the formwork alternating in orientation from a first matrix layer of the formwork in a frame located below the plurality of legs configuration to, a second layer of the formwork in a frame located above the plurality of legs configuration. The matrix may further include the vertical coupling of each formwork couples the first matrix layer of formwork with the second matrix layer of further formwork.

Multi-Layered Matrix

In the above aspect, two formwork are used stacked in an alternating manner on top of each other to form the matrix, each formwork coupling to another formwork via the legs.

A multi-layered matrix may include multiple layers of three or more formwork which may include a first matrix layer of the formwork in a frame located below the plurality of legs configuration to, a second layer of the formwork in a frame located above the plurality of legs configuration, and a third layer of the formwork located on the second layer of the formwork in a frame located below the plurality of legs configuration. The multi-layered matrix may, optionally, include a further layer of the formwork located on the third layer of the formwork in a frame located above the plurality of legs configuration. The multi-layered matrix may further include layers which may be added beyond a third (or further layer) described above.

The layers of the matrix may alternate in a manner from leg to leg vertical coupling to frame to frame vertical coupling in the above example.

Vertical coupling of the formwork frames may be achieved via male female fittings, slots and extensions, or simply via friction.

Side Panels

The matrix may comprise a top, a bottom, and sides. At least one side panel may be fitted to the side or sides of the matrix.

The side panels may be fixed to the matrix by attachment to a formwork or multiple formwork of the matrix. The side panels may snap fit onto the matrix or formwork sides.

Side panels may be used to prevent ingress of backfill into the matrix once assembled.

Concrete Matrix

In a third aspect, there is provided a concrete matrix which may include a matrix comprising a plurality of formwork substantially as described above, and concrete within the internal void space of the formwork in the matrix.

Method of Forming a Matrix

In a fourth aspect, there is provided a method for forming a matrix by pouring of concrete therein, which may include selecting a plurality of formwork substantially as described above. The method may further include forming a first matrix layer by placing, on a substrate, multiple formwork, the multiple formwork orientated in a configuration with the formwork frame located below the second ends of the legs. The method may also include forming a second matrix layer, over the first matrix layer, by vertically coupling the second ends of the legs of each formwork in the second matrix layer to the second ends of the legs in the first matrix layer, the formwork of the second matrix layer orientated in a configuration with the formwork frame located above the second ends of the legs.

Method of Forming a Multi-Layered Matrix

Optionally a multi-layered matrix may be formed by forming a third or further layer on the second layer by coupling the formwork frame of the second matrix layer to a third matrix layer and, optionally, via the third formwork and further formwork legs, forming a further layer.

Horizontal Coupling

The method may comprise a further step of coupling the formwork of the first matrix layer, or the second matrix layer, or both the formwork of the first or the second matrix layer, together in a horizontal plane.

Method of Forming a Concrete Matrix

In a fifth aspect, there is provided a method of forming a concrete matrix which may include selecting a plurality of formwork substantially as described above. The method may also include forming a first matrix layer by placing, on a substrate, multiple formwork, the multiple formwork orientated in a configuration with the formwork frame located below the second ends of the legs. The method may further include forming a second matrix layer, over the first matrix layer, by vertically coupling the second ends of the legs of each formwork in the second matrix layer to the second ends of the legs in the first matrix layer, the formwork of the second matrix layer orientated in a configuration with the formwork frame located above the second ends of the legs. The method may also include pouring concrete into the internal volume of the plurality of formwork and allowing the poured concrete to cure and harden in the internal void space of the plurality of formwork.

Multi-Layered Concrete Matrix

As described above, additional third or further layers may be used to form a multi-layered matrix of formwork. The above method of forming a concrete matrix may also be adapted by the addition of further formwork layers and then pouring concrete in the internal volume of the multi-layered formwork matrix.

Advantages

Advantages of the above formwork, matrices, and methods may comprise one or more of the following:

No separate plate is needed in this revised design to retain the legs together. A separate plate is however an option to facilitate stacking of formwork particularly those under particularly heavy loads but this is not essential;

- No collar(s) is required to link the leg terminal ends together;
- The formwork leg size may be larger and hence may be easier to direct concrete into and for concrete to flow through;
- The formwork and matrix using the formwork may require fewer parts than previous formwork;
- The exterior and interior of the leg terminal end may have a smoother shape than art coupling formwork facilitating easier flow of concrete through the legs during pouring (internal) and no exterior obstructions or pinch points;
- The formwork and matrices may facilitate snap fit design and installation and hence the ability to assemble the matrix toolessly.

The embodiments described above may also be said broadly to consist in the parts, elements and features referred to or indicated in the specification of the application, individually or collectively, and any or all combinations of any two or more said parts, elements or features.

Further, where specific integers are mentioned herein which have known equivalents in the art to which the embodiments relate, such known equivalents are deemed to be incorporated herein as if individually set forth.

WORKING EXAMPLES

The above described formwork, matrices, concrete matrices and methods of manufacture are now described by reference to specific examples and with reference to the following items and item numbering:

1 Formwork
2 Frame
3 Lateral supports
3*a* Internal lateral supports
3*b* External lateral supports
4 Volume within the lateral support
5 Base
6 Sides
7 Open top
8 Legs
9 Leg first end
10 Leg second end
11 Leg vertical coupling
12 Leg elongated tabs
13 First diameter opening
14 Second diameter opening
15 Wall structure
16 Smooth walled hollow
17 External void space outside of the frame lateral supports and legs
18 Internal void space located inside the plurality of legs and the volume within the lateral supports
19 Regions where no elongated tabs is present intermediate the elongated tabs
20 Smooth exterior when legs coupled
21 Smooth interior when legs coupled
22*a* Recess and shoulder for grill in legs
22*b* Recess and shoulder for grill in lateral supports
23 Retention feature
24 Hook cross section shape
25 Barb/hook
30 Horizontal coupling
31 First end of an external lateral support
32 Second end of an external lateral support
33 Male fitting
34 Female fitting
50 Further formwork
51 Second terminal end of a leg from further formwork
52 Further vertical coupling
58 Further formwork legs
70 Grill
71 Outer frame
72 Internal webbing
73 Grill shoulder
80 Side panel
81 Side panel interior side
82 Side panel exterior side
100 Matrix for formwork
110 First matrix layer
120 Second matrix layer

Example 1

In this example, a formwork 1 is described.

As shown in FIGS. 1-5, an individual formwork 1 comprises a frame 2 having lateral supports 3 and legs 8 linked to the lateral supports 3. The legs 8 extend orthogonally from the frame 2. The frame 2 couples the first end 9 of the legs 8 together via the lateral supports 3.

The lateral supports 3 define a volume 4 within the lateral supports 3, defined by a base 5, sides 6 and an open top 7.

The formwork 1 as shown has four spaced part legs 8. Each leg 8 has a first end 9 that is open and a second end 10 that is also open.

The leg first end 9 has a first diameter opening tapering to a smaller second diameter opening about the leg second end 10.

The legs 8 are connected to the frame 2 at the first end 9 of each leg 8. The legs 8 extend orthogonally away from the frame 2 to the leg second ends 10.

The frame 2 comprising the lateral supports 3 and leg 8 first ends 9 forms a generally planar flat surface across and outer edge of the lateral supports 3 and leg 8 first ends 9.

The formwork 1 defines an external void space 17 outside of the frame 2 lateral supports 3 and legs 8. The formwork 1 also defines an internal void space 18 located inside the plurality of legs 8 and the volume 4 within the lateral supports 3. The internal void space 18 of the formwork 1 is configured to receive and retain concrete (not shown) therein.

The second end 10 of the legs 8 comprises a vertical coupling 11. The vertical coupling 11 is configured to couple with a further tabs 52 located on a second terminal end 51 of a leg 58 from a further formwork 50.

Figure 6:
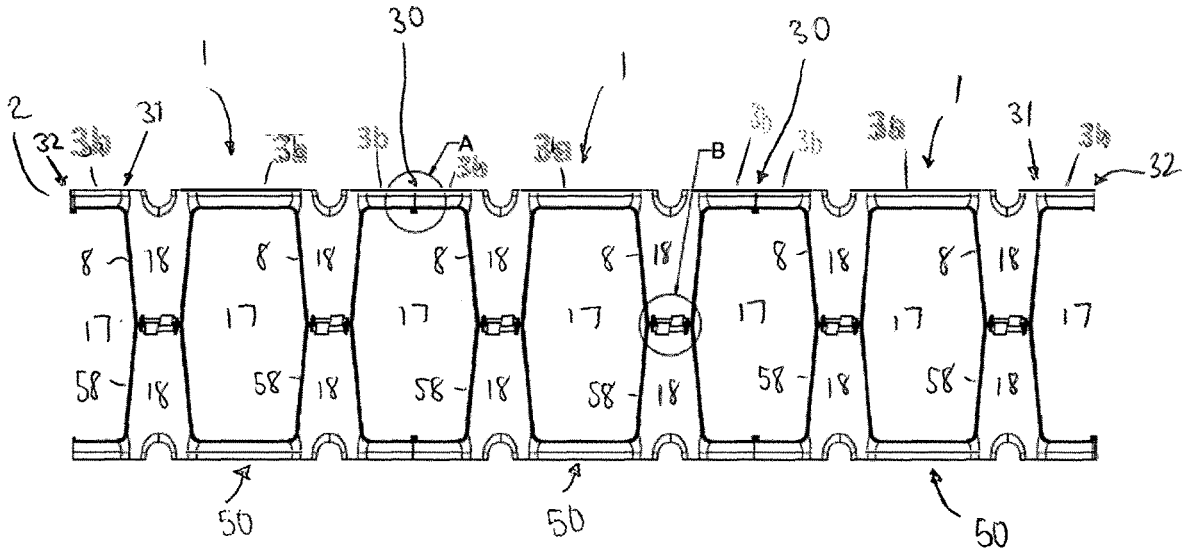
FIG. 6 illustrates a front elevation cross-section view of a matrix formed from multiple first and further formwork linked in both a vertical and horizontal plane.
Figure 8:
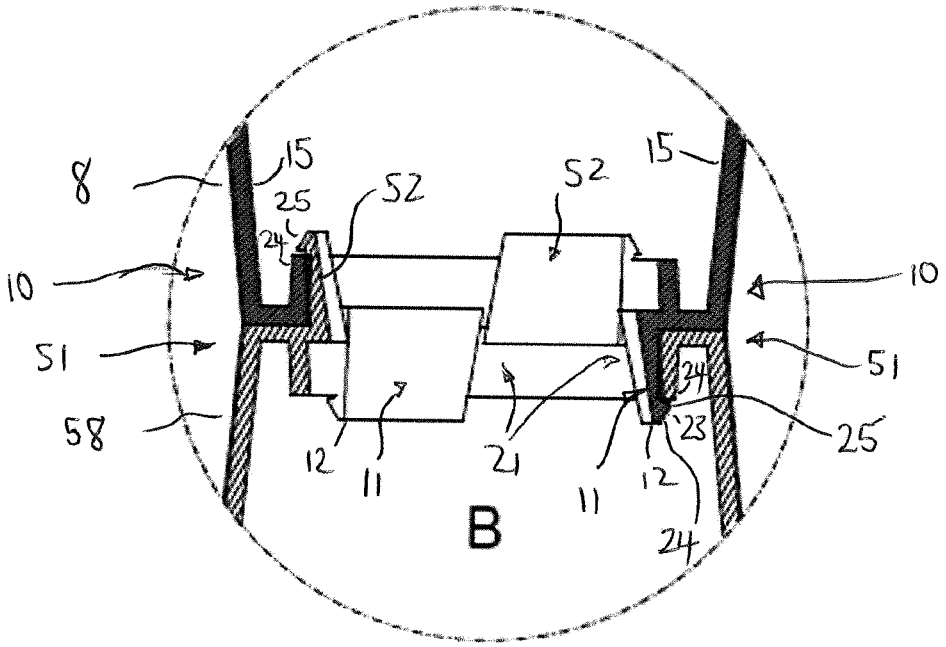
FIG. 8 illustrates a detail cross-section front elevation view of item B in FIG. 6 showing a coupling between the leg terminal end of a first and further formwork.

FIGS. 6 and 8 show the vertical coupling 11 in more detail. As shown, the vertical coupling 11 comprises elongated tabs 12 extending from the second end 10 of the legs 8. The elongated tabs 12 may be configured to nest and snug fit into the second diameter opening of a further formwork 50 leg 58 second end 51.

Each elongated tab 12 may be generally flat and shaped to nest with the interior of the leg 8 wall structure 15 or a part thereof.

The vertical coupling 11 may further comprise regions 19 where no elongated tabs 12 are present 19. These regions 19 may be located intermediate the elongated tabs 12 and configured to receive elongated tabs 52 from the further formwork 50 leg 58 second end 51. As may be appreciated, the elongated tabs 12, 52 may act as a male coupling fitting into the non-elongated tab 12 regions 19 in the second end 10 of the legs 8 which act as a female portion of the vertical coupling 11.

The vertical coupling 11 may be configured to provide a smooth interior face 21 between the second ends 10 of the legs 8 so as to facilitate concrete flow from one leg 8 to a further leg 58.

The leg 8 second end 10 may further comprise a retention feature 23 forming a hook cross section shape 24. In this example, the elongated tab 12 may be shaped as a resilient member. When two formwork 1, 50 are coupled together vertically via the leg 8 second ends 12, the resilient member elongated tab 12 may have a barb/hook 25 configured to snap fit over the return shape 24 of the leg 8 second end 10 to lock the formwork 1, 50 together.

Figure 7:
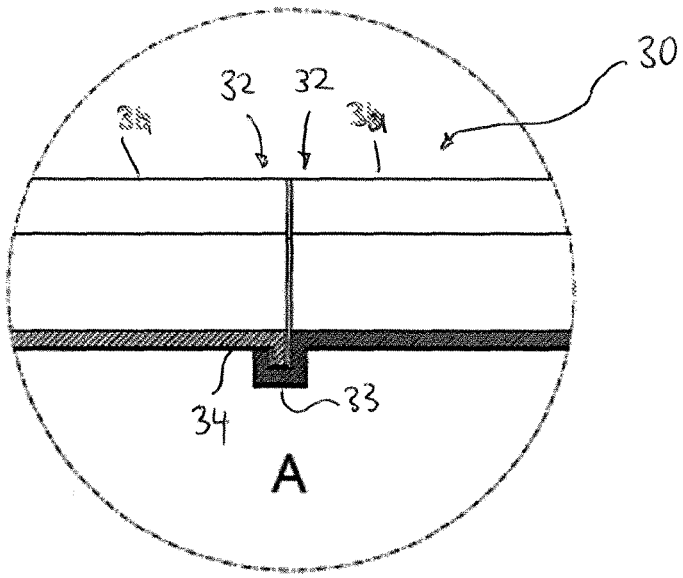
FIG. 7 illustrates a detail cross-section front elevation view of item A in FIG. 6 showing a coupling between the lateral supports of opposing formwork in a horizontal plane.

A horizontal coupling 30 may also be used shown in FIGS. 6 and 7. The frame 2 may comprise internal lateral supports 3*a* between the formwork 1 legs 8 and external lateral supports 3*b* extending from the legs 8. The internal lateral supports 3*a* may be of a uniform length while the external lateral supports 3*b* may also be of a uniform length that is a length approximately half the length of the internal lateral supports 3*a*.

The external lateral supports 3*b* may extend from the legs 8 in a direction parallel to the direction of an adjoining internal lateral support 3*a*. Each external lateral support 3*b* may comprise a first end 31 about the formwork 1 leg 8 and a second end 32 distal to the leg 8. The second end 32 of each external lateral support 3*b* comprises a horizontal coupling 30 configured to allow formwork 1 to be coupled together in a horizontal alignment.

In the example shown, the second end 32 of each external lateral support 3*b* comprises a male or female fitting 33, 34.

The external lateral support 3*b* second end 32 of a formwork 1 may comprise alternating male and female fittings 33, 34 on each side of a formwork 1 configured to allow formwork 1 horizontal coupling 30 about the described horizontal plane.

Example 2

In this example, a matrix 100 of the formwork 1 is described.

Figure 9:
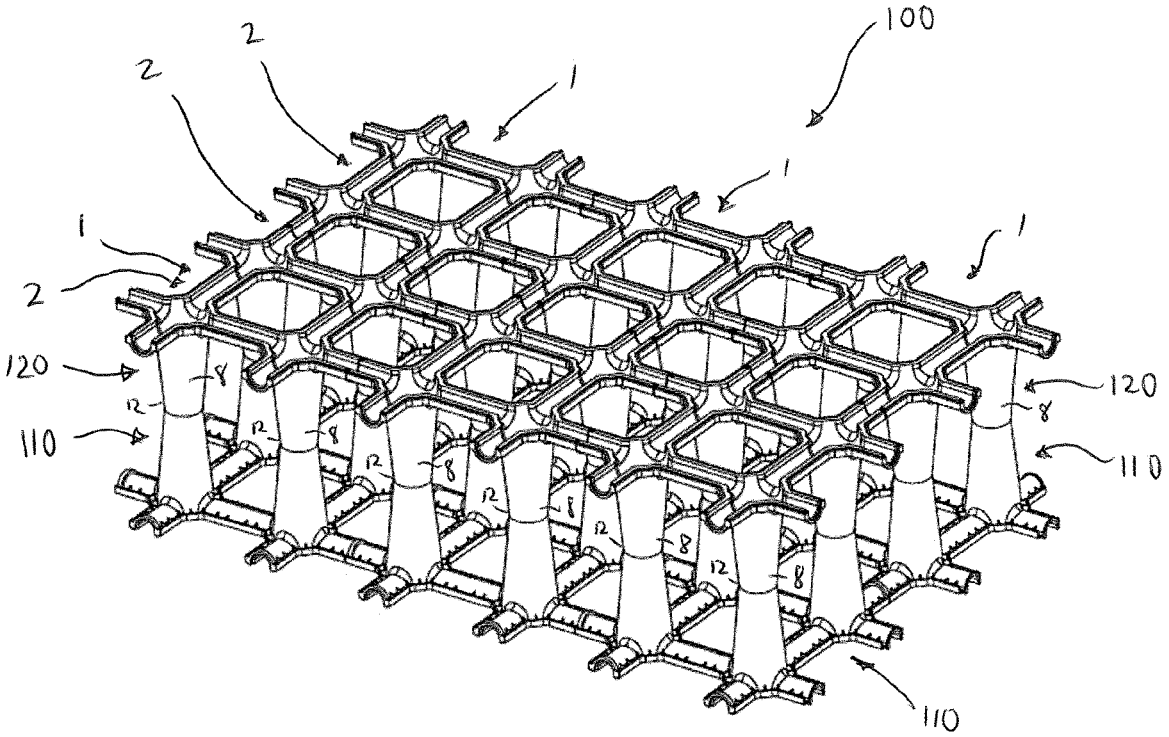
FIG. 9 illustrates a perspective view of a matrix formed from multiple formwork coupled vertically in an alternating arrangement and coupled horizontally about a common horizontal plane.
Figure 10:
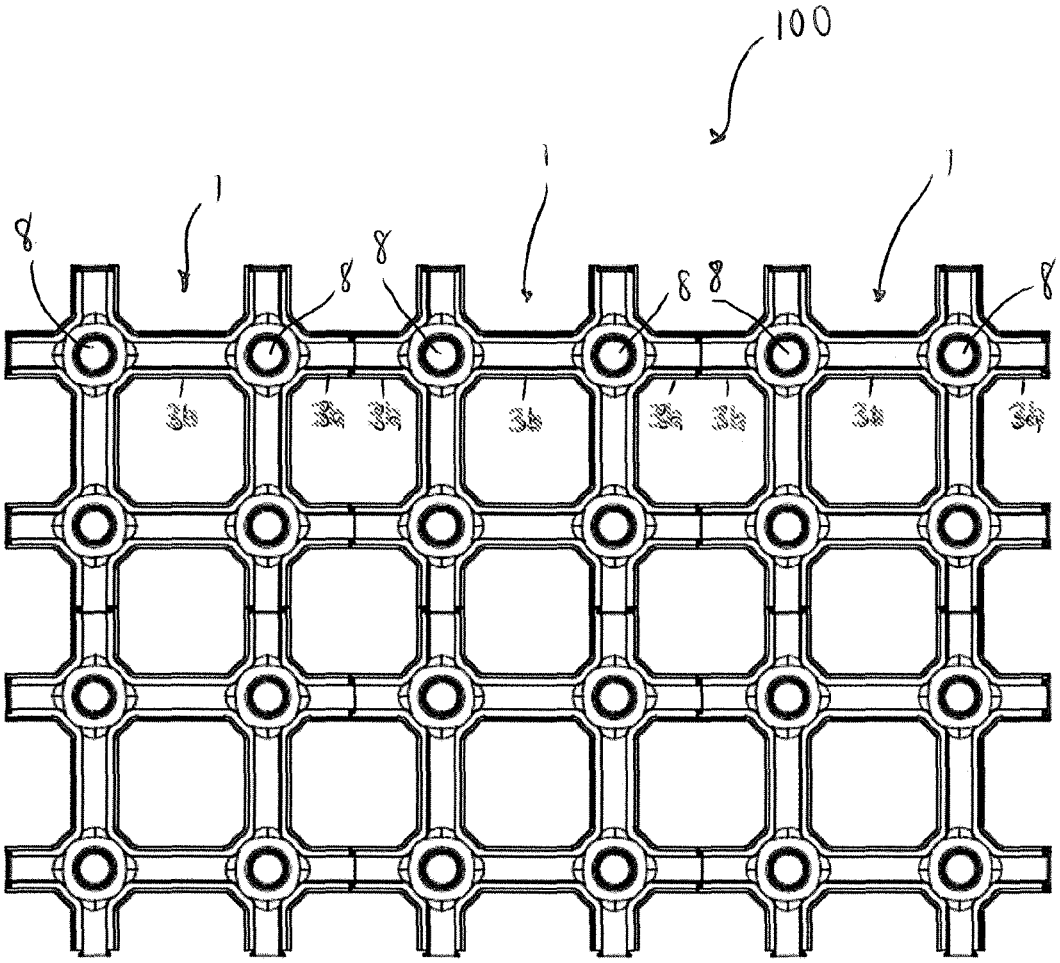
FIG. 10 illustrates a plan view of the matrix of FIG. 9.
Figure 11:
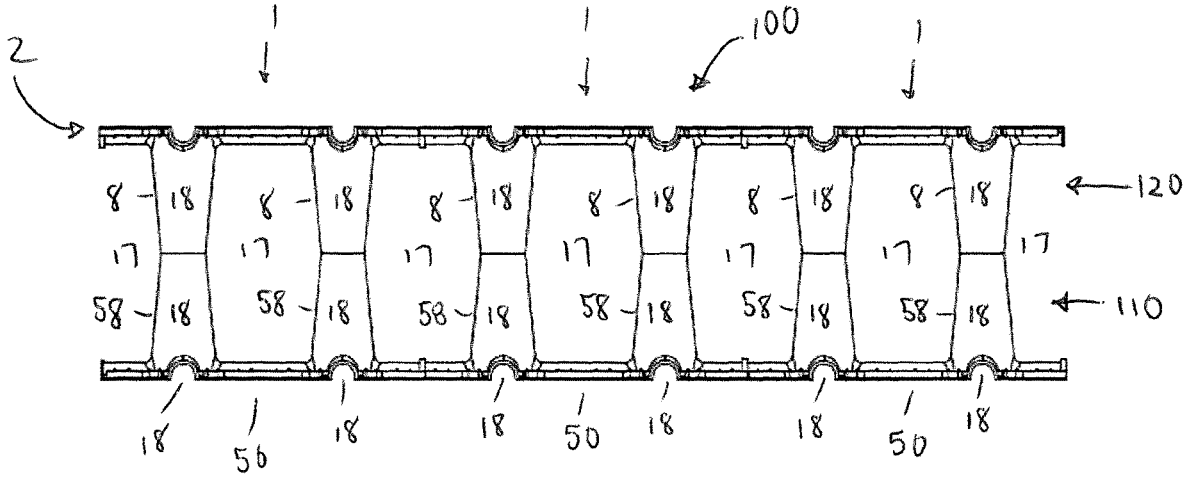
FIG. 11 illustrates a front elevation view of the matrix of FIG. 9.

FIGS. 9-11 illustrate matrix 100 formed from multiple formwork 1 coupled vertically in an alternating arrangement and coupled horizontally about a common horizontal plane.

The formwork 1 forming the matrix 100 are aligned vertically. Each frame 2 of the formwork 1 alternates in orientation from a first matrix layer 110 of the formwork 1 in a frame 2 located below the plurality of legs 8 configuration, to a second matrix layer 120 of the formwork 1 in a frame 2 located above the plurality of legs 8 configuration. Vertical coupling of each formwork 1 couples the first matrix layer 110 of formwork 1 with the second matrix layer 120 of formwork 1 via the leg 8 second ends 12.

Example 3

In this example, the use of a grill 70 or blank is described. Reference in the drawings and description below is made to a grill 70 comprising an outer frame 71 and internal webbing 72 with openings. The grill 70 may instead be a blank (not shown) in which case the internal webbing 72 of the grill 70 may be a plate or filled in structure that blocks entry to the leg 8 opening. Reference to grill 70 may be used interchangeably with a blank.

Figure 12:
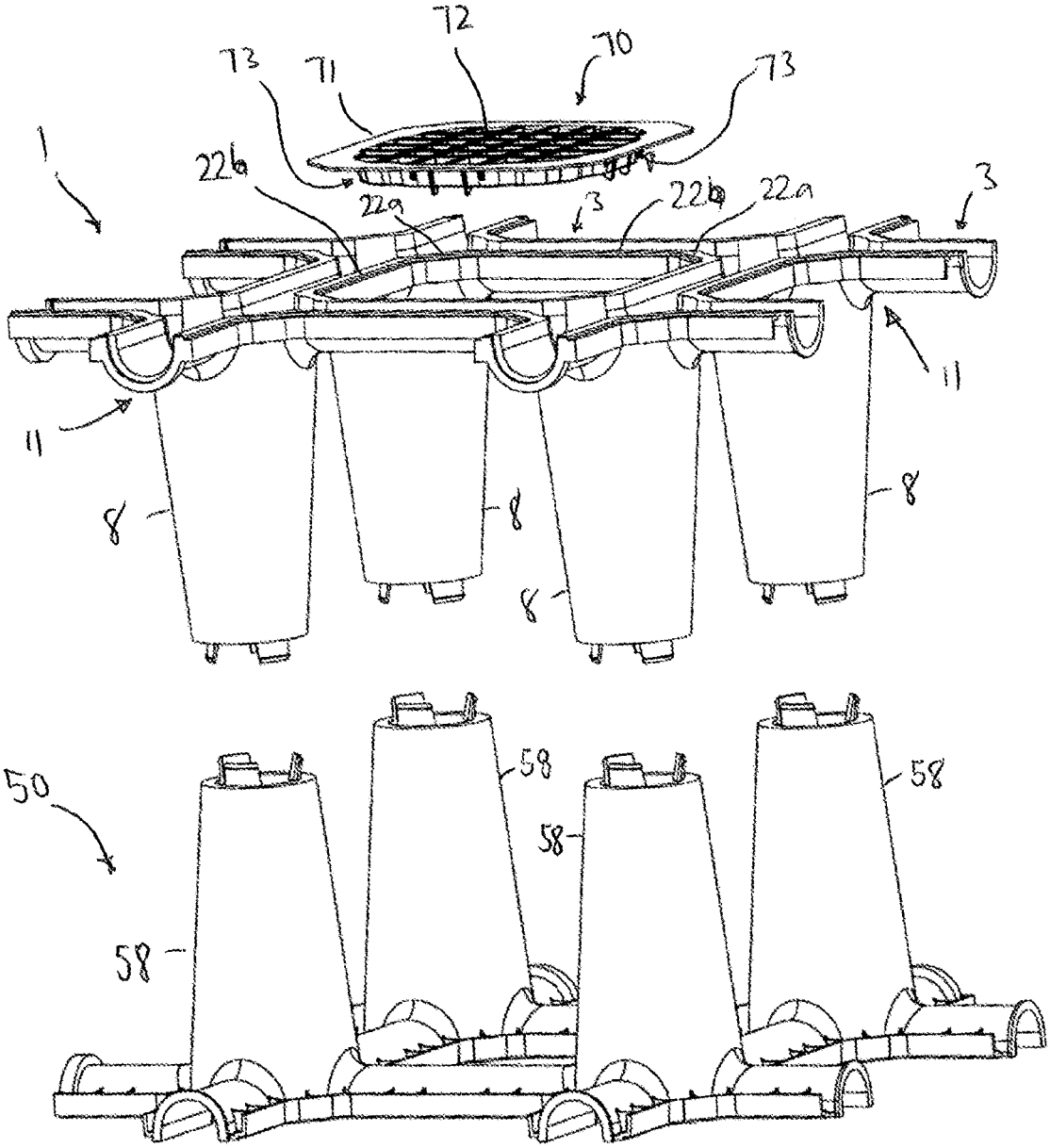
FIG. 12 illustrates an exploded perspective view of a first and further formwork with a grill.
Figure 13:
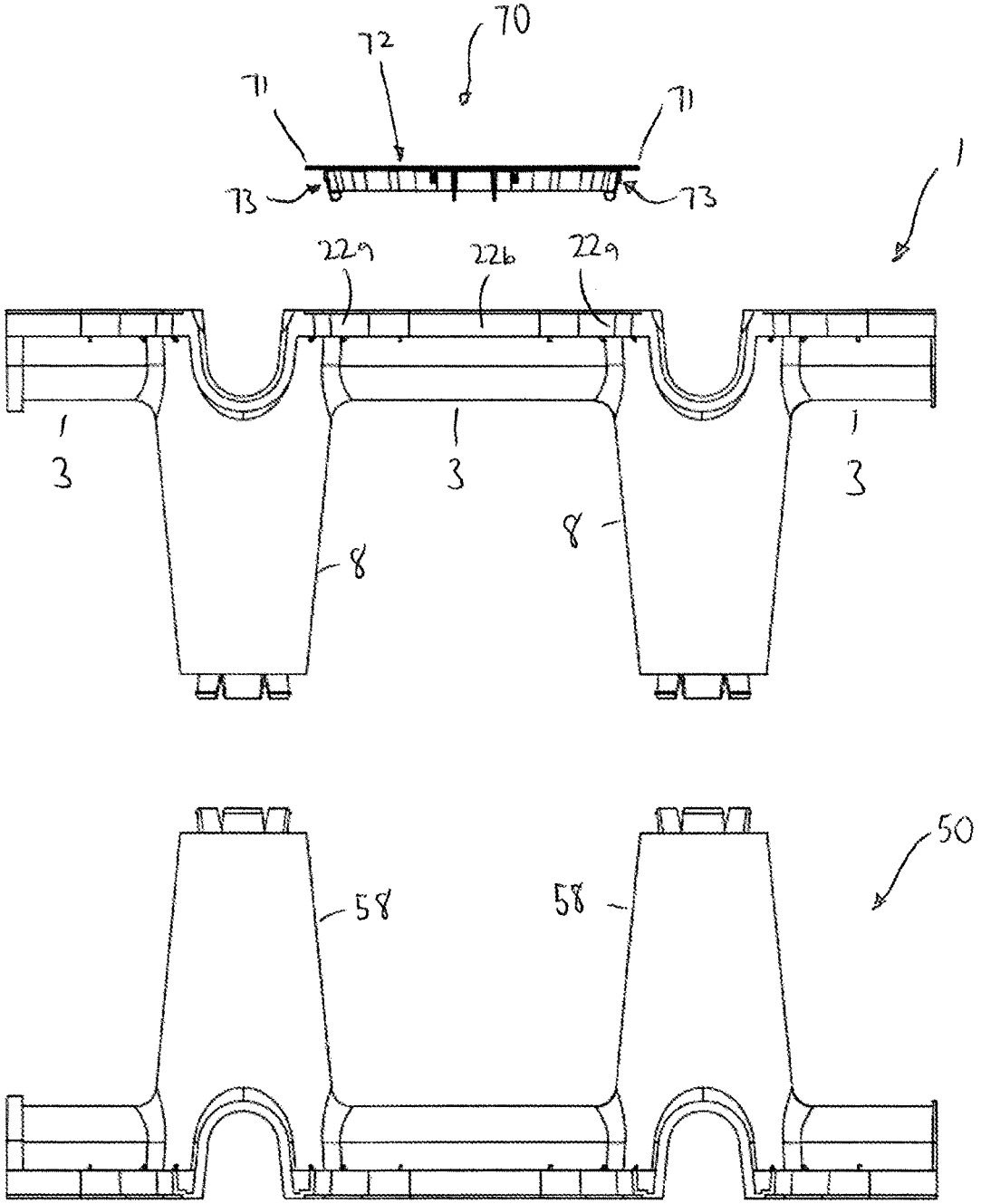
FIG. 13 illustrates an exploded front elevation view of a first and further formwork with a grill.
Figure 14:
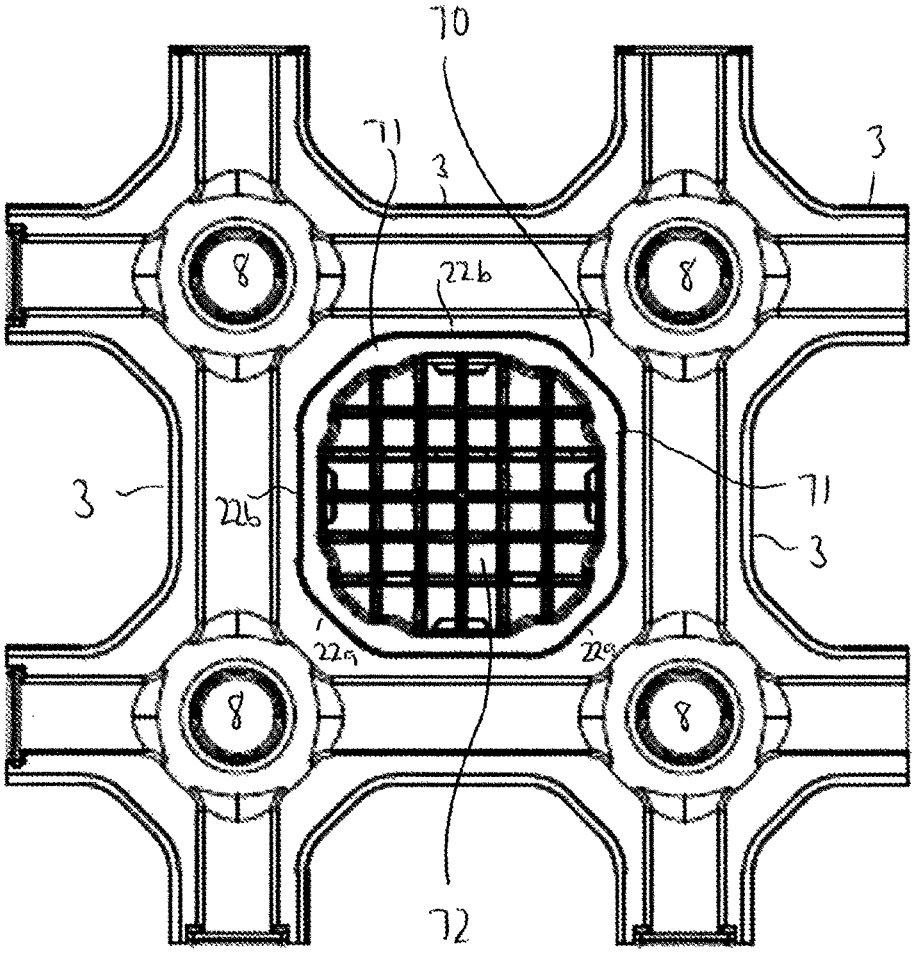
FIG. 14 illustrates a plan elevation view of a first and further formwork coupled together in a vertical plane along with a grill fitted to the first formwork.
Figure 15:
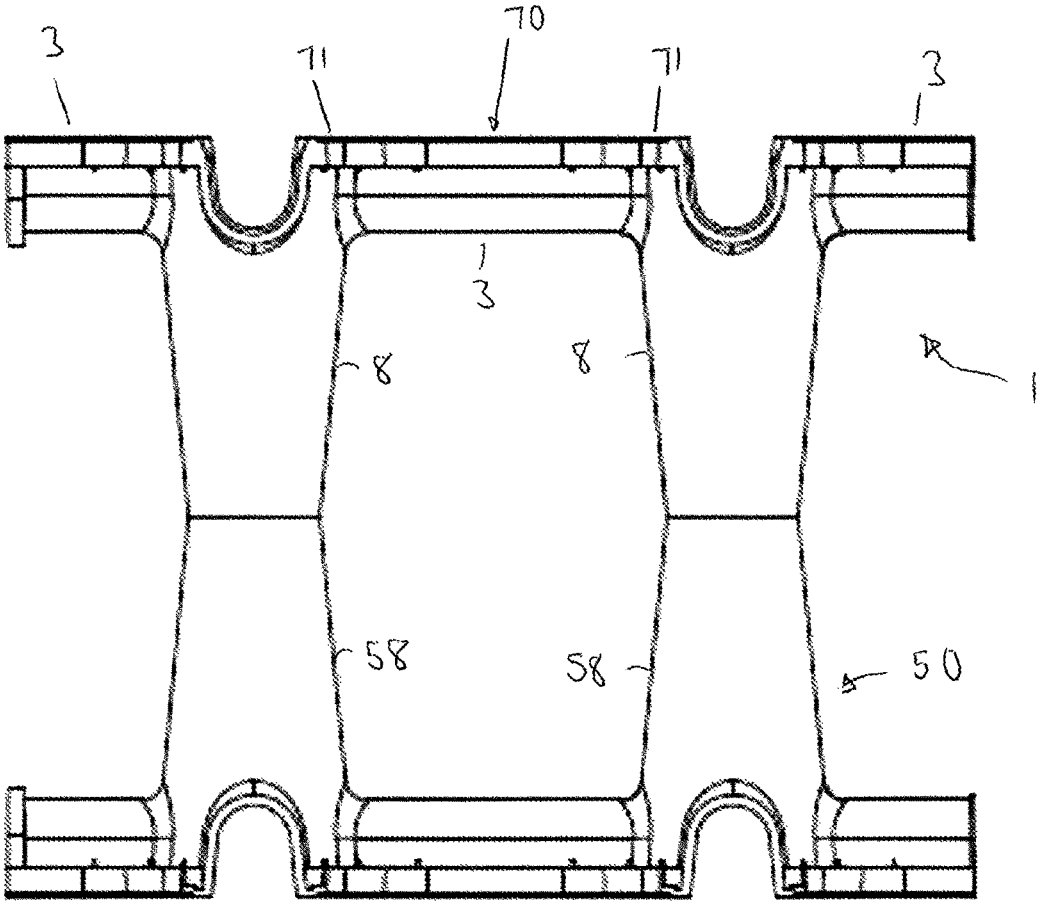
FIG. 15 illustrates a front elevation view of a first and further formwork coupled together in a vertical plane with a grill.
Figure 16:
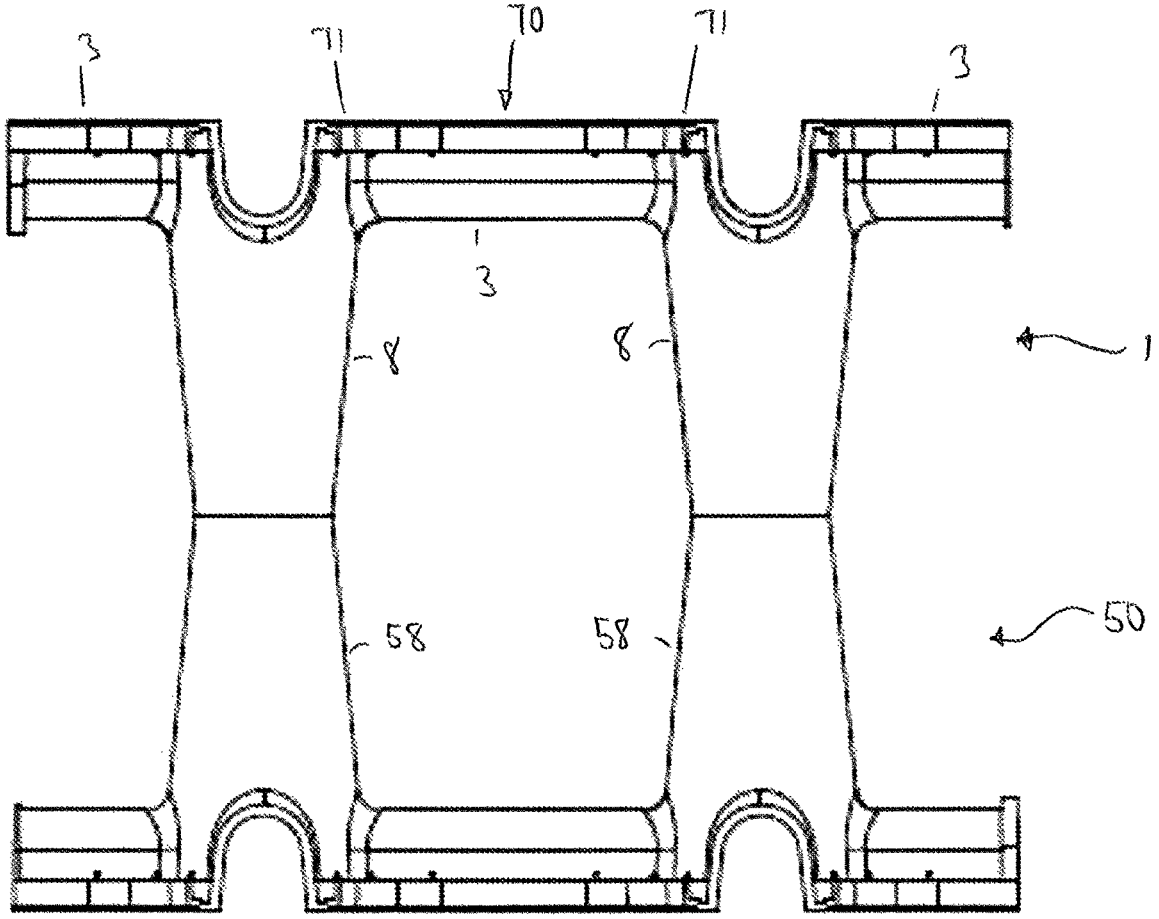
FIG. 16 illustrates a side elevation view of a first and further formwork coupled together in a vertical plane with a grill.
Figure 17:
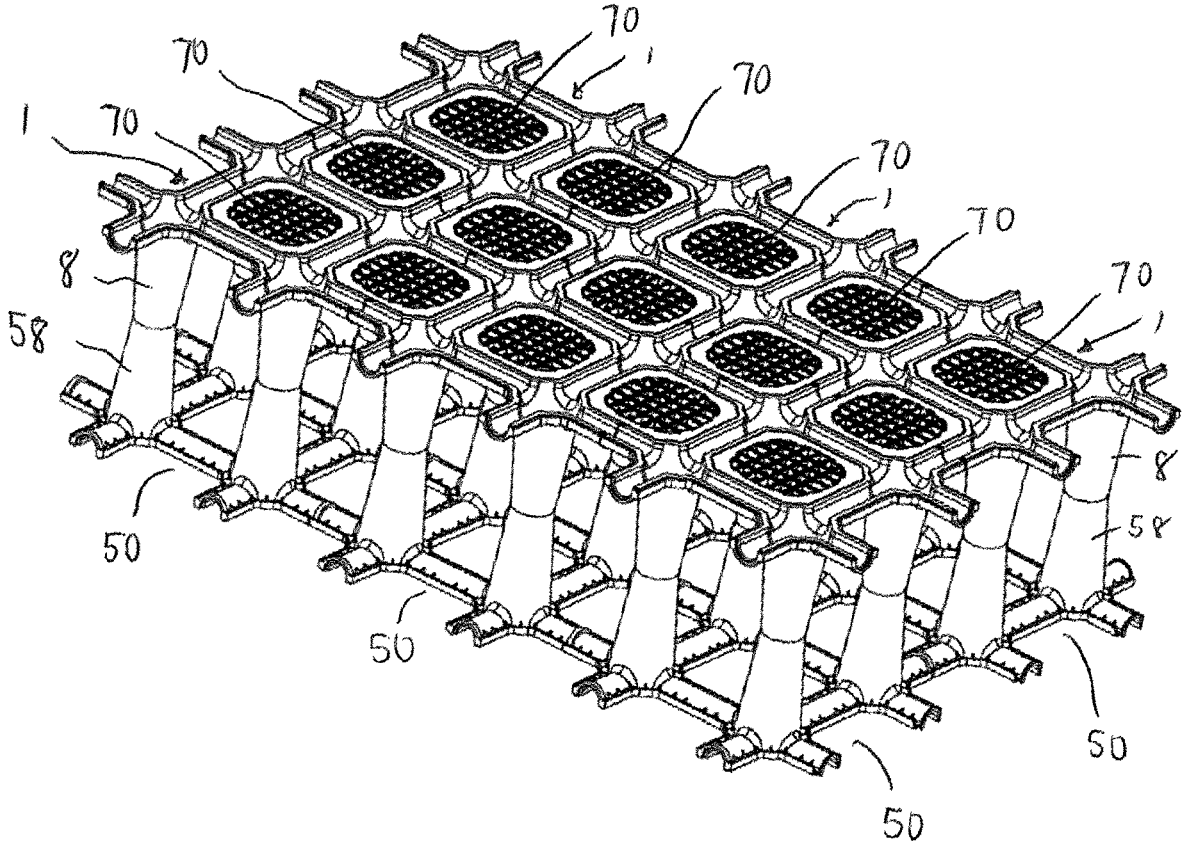
FIG. 17 illustrates a plan elevation view of a matrix of first and further formwork coupled together in vertical and horizontal planes along with grills placed in the first formwork of the matrix.

FIGS. 12-13 illustrate exploded views of a first and further formwork 1, 50 with a grill 70. FIGS. 14-17 illustrate views of the first and further formwork 1, 50 coupled together in a vertical plane along with a grill 70 fitted to the first formwork 1.

The formwork 1 leg 8 first end 10 is shaped to receive a grill 70 over the opening.

The leg 8 first end 10 comprises a recess and shoulder 22*a* adapted to nestingly receive a grill 70 or blank therein. The lateral supports 3 may also comprise a recess and shoulder 22*b* adapted to also nestingly receive part of a grill 70 or blank therein. The grills 70 comprise an outer frame 71 with a shaped internal shoulder 73, the shaped internal shoulder 73 of the grill 70 complementing the shape of the recess and shoulder 22*a*, 22*b* of the leg 8 first end 10 and lateral supports 3.

The grills 70 may connect to/interact with the legs 8 and lateral supports 3 to fix them in place relative to the formwork 1. Alternatively, the grills 70 may sit on the formwork 1 and not be directly connected to the formwork 1. The grills 70 may be seated on the formwork 1 via gravity and friction only.

Example 4

This example describes a further embodiment of matrix 100 having side panels 80.

Figure 18:
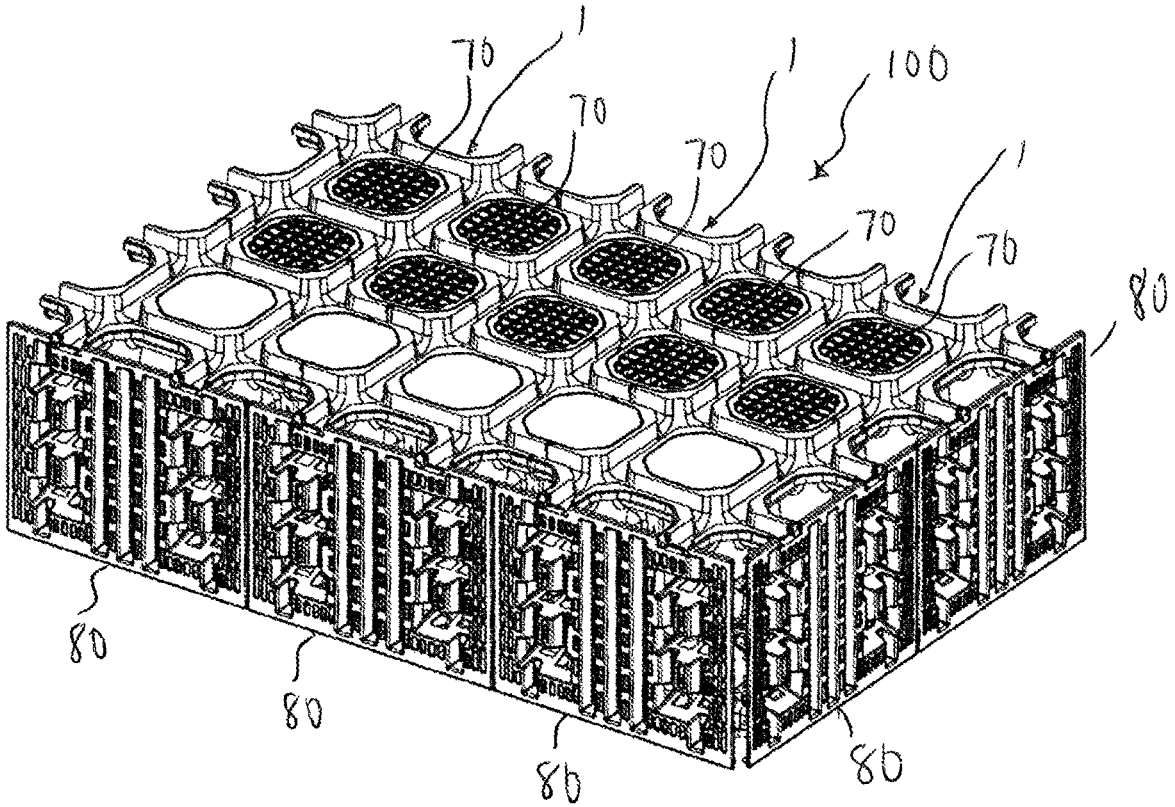
FIG. 18 illustrates a perspective view of a matrix of formwork coupled together in vertical and horizontal planes along with side panels shown on two sides of the matrix and a limited number of grills.
Figure 19:
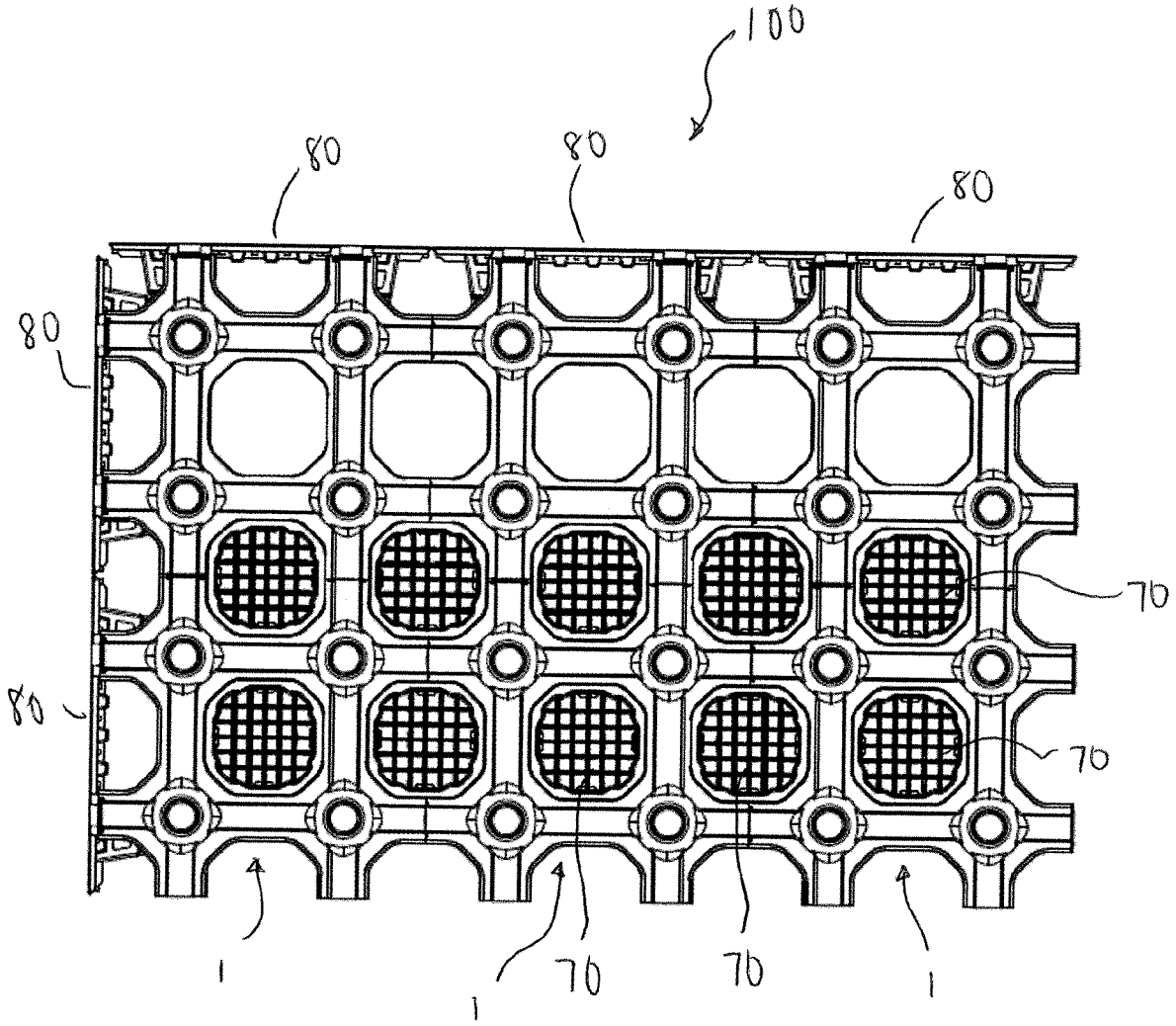
FIG. 19 illustrates a plan elevation view of a matrix of formwork coupled together in vertical and horizontal planes along with side panels shown on two sides of the matrix and a limited number of grills.
Figure 20:
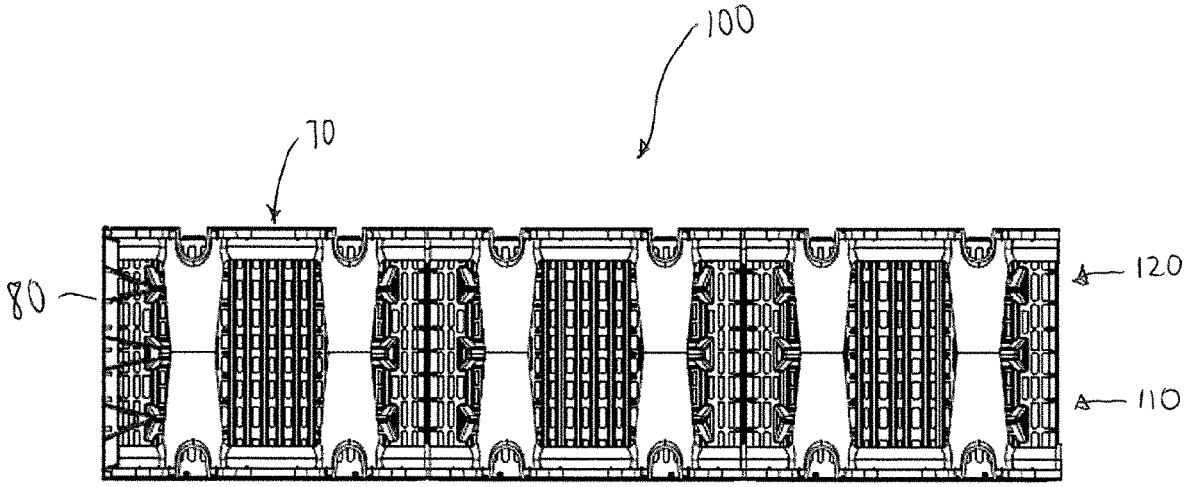
FIG. 20 illustrates a front elevation view of a matrix of formwork coupled together in vertical and horizontal planes along with side panels shown on two sides of the matrix and a limited number of grills.

FIGS. 18-20 illustrate a matrix 100 of formwork 1 coupled together in vertical and horizontal planes along with side panels 80 shown on two sides of the matrix 100 and a limited number of grills 70 applied to the top of the matrix 100 formwork 1. As shown, the matrix 100 sides may have a side panel or side panels 80 fitted to the formwork 1 of the matrix 100. The side panels 80 may be fixed to formwork 1 in the matrix 100.

Side panels 80 may have an elongated rectangular shape with a length corresponding to the length of a matrix 100 side to be covered or a part thereof. The side panel 80 may have a length that covers at least two sets horizontally of formwork 1. The side panel 80 may have a height corresponding to the height of two formwork 1 stacked on top of each other in the alternating manner described earlier in this specification. The width of a side panel 80 may be smaller than the length or height or the side panel 80.

The side panel 80 may comprise opposing sides 81, 82 being an interior side 81 that faces the matrix 100 and, an exterior side 82 that faces away from the matrix 100. The interior side 81 may comprise fastening members (not shown) to fasten the side panel 80 to a formwork 1 or multiple formwork 1 of the matrix 100. The fastening members may snap fit to the formwork 1 although, other mechanisms of attaching the side panels 80 to the formwork 1 may also be used.

Side panels 80 on the matrix 100 may be useful to prevent ingress of backfill (not shown) into the matrix 100 once the matrix 100 is assembled and buried beneath a hardscape (not shown).

Aspects of the formwork, matrices, concrete matrices and methods of manufacture have been described by way of example only and it should be appreciated that modifications and additions may be made thereto without departing from the scope of the claims herein.

What is claimed is:

1. A formwork configured to receive and retain concrete therein, the formwork comprising:

a frame comprising lateral supports, each lateral support defining a volume within the lateral support, the volume defined by a base, sides, and an at least partially open top;

at least four legs, each leg comprising:

a tapering wall structure defining a hollow interior;

a leg first end and a leg second end, both the leg first end and the leg second end opening to the hollow interior;

the leg first end having a first diameter opening tapering to a second diameter opening about the second end, the first diameter opening being larger than the second diameter opening;

the legs connected to the frame at the first end of each leg, the legs extending orthogonally away from the frame to the second ends of the legs;

the leg second end of the legs comprising a vertical coupling, the vertical coupling configured to couple with a further vertical coupling located on a second end of a leg from a further formwork and, wherein the vertical coupling is configured to provide a smooth and continuous interior face flush within the hollow interior between the second ends of the legs so as to facilitate concrete flow from one leg to a further leg, the vertical coupling including elongated tabs extending from the second end of the legs, the elongated tabs arranged to nest and snug fit into complementary regions of the second end of the leg of the further formwork; wherein the vertical coupling includes a retention feature configured to lock the formwork to the further formwork;

wherein the frame couples the first end of the legs together via the lateral supports; and, wherein the formwork defines:

an external void space outside of the lateral supports and legs; and, an internal void space located inside the hollow interior of the legs and the volume within the lateral supports, wherein the internal void space is continuous and not segmented and is configured to receive and retain concrete therein.

2. The formwork as claimed in claim 1, wherein the formwork defines a generally cuboid volume and the frame defines a generally square cross-section shape in a horizontal plane.

3. The formwork as claimed in claim 1, wherein the lateral supports include internal lateral supports between the legs and external lateral supports extending from the legs, and wherein each external lateral support comprises a horizontal coupling formed in one piece with, and integral to, the external lateral support at a distal second end of the external lateral support, the horizontal coupling comprising a male fitting or a female fitting configured to directly interlock with a complementary horizontal coupling of an adjacent further formwork about a horizontal plane without any intervening plate or separate connector.

4. The formwork as claimed in claim 1, wherein the frame comprises internal lateral supports between the legs and comprises external lateral supports extending from the legs wherein:

the internal lateral supports are of a uniform length and link each of the legs together;

the external lateral supports are of a uniform length substantially half the length of the internal lateral supports; and the external lateral supports extend from the legs in a direction parallel to and coincident with, the direction of an adjoining internal lateral support.

5. The formwork as claimed in claim 4, wherein each external lateral support comprises a first end about the leg first end and a second end distal to the leg first end of the leg.

6. The formwork as claimed in claim 5, wherein the second end of each external lateral support comprises a horizontal coupling configured to allow the formwork and a further formwork to be coupled together in a horizontal alignment.

7. The formwork as claimed in claim 1, wherein the first end of the leg comprises a recess and shoulder adapted to nestingly receive a grill or a blank, the grill or blank having an outer frame with a complementary peripheral shoulder configured to seat within the recess and shoulder at the leg first end to cover the opening to the hollow interior, the grill or blank being configured to connect to and/or interact with the legs and the lateral supports to fix the grill or blank in place.

8. The formwork as claimed in claim 1, wherein the internal void space is formed as one integral molded volume and the legs and lateral supports are integral and not separate parts.

9. The formwork of claim 6, wherein the horizontal coupling of each external lateral support includes at least one of: a male fitting or a female fitting.

10. The formwork of claim 6, wherein the second ends of the external lateral supports include alternating male fittings and female fittings, and wherein the alternating male fittings and female fittings are configured for alternating formwork coupling about a horizontal plane.

11. The formwork as claimed in claim 1 wherein the leg first end comprises a recess and shoulder adapted to nestingly receive a removable grill or blank therein;

wherein the lateral supports comprise a recess and shoulder adapted to also nestingly receive part of the grill or blank; and wherein the grill or blank is configured to seat within the recess and shoulder at the leg first end to cover the opening to the hollow interior and to connect to and/or interact with the legs and the lateral supports.

12. The formwork as claimed in claim 1, wherein each lateral support comprises, at a distal end, a horizontal coupling formed as an open channel that is continuous with the volume within the lateral support and has an at least partially open top, the horizontal coupling configured to directly interlock with a complementary horizontal coupling of an adjacent further formwork about a horizontal plane so that, when interlocked, the open channel defines a through-passage that permits unhindered concrete flow between the internal void spaces.

13. A matrix comprising a plurality of formwork as claimed in claim 1, wherein:

the formwork forming the matrix are aligned vertically with each said frame of the formwork alternating in orientation from:

a first matrix layer of the formwork located below the at least four legs;

a second matrix layer of the formwork located above the at least four legs; and wherein the vertical coupling of each formwork couples the first matrix layer of formwork with the second matrix layer of the further formwork.

14. The matrix as claimed in claim 13, wherein the matrix comprises multiple layers of three or more formwork comprising:

a third matrix layer of the formwork located on the second matrix layer of the formwork and below a further at least four legs of the formwork.

15. The matrix as claimed in claim 14, wherein the multiple layers of the matrix alternate in a manner from leg to leg vertical coupling to frame to frame vertical coupling.

16. The matrix as claimed in claim 13, wherein the matrix comprises a top, a bottom, and sides, and wherein at least one side panel is fitted to the side or sides of the matrix, wherein the at least one side panel has an interior side with fastening members configured to snap fit to a formwork or multiple formwork of the matrix, and wherein the at least one side panel has a height corresponding to a height of two formwork of the plurality of formwork stacked in an alternating manner, so as to span vertically adjacent formwork and be secured to the matrix.

17. The matrix as claimed in claim 13, wherein the matrix comprises a top, a bottom, and sides, and wherein at least one side panel is fitted to the side or sides of the matrix, the side panel having an interior side with fastening members configured to snap fit to a formwork or multiple formwork of the matrix, a length spanning at least two formwork horizontally along a side of the matrix, and a height corresponding to a height of two formwork stacked in an alternating manner so as to span vertically adjacent formwork and be secured to the matrix.

18. A concrete matrix comprising:

a matrix comprising a plurality of formwork with concrete within an internal void space of the formwork in the matrix;

the formwork comprising:

a frame comprising lateral supports, each lateral support defining a volume within the lateral support, the volume defined by a base, sides and an at least partially open top;

at least four legs, each leg comprising:

a tapering wall structure defining a hollow interior;

a leg first end and a leg second end, both the leg first end and the leg second end opening to the hollow interior;

the leg first end having a first diameter opening tapering to a second diameter opening about the second end, the first diameter opening being larger than the second diameter opening;

the legs connected to the frame at the first end of each leg, the legs extending orthogonally away from the frame to the second ends of the legs;

the second end of the legs comprising a vertical coupling, the vertical coupling configured to couple with a further vertical coupling located on a second end of a leg from a further formwork and, wherein the vertical coupling is configured to provide a smooth interior face between the second ends of the legs so as to facilitate concrete flow from one leg to a further leg, wherein the vertical coupling includes an elongated tab with a hook-shaped cross-section configured to engage the further formwork with a snap fit and to thereby secure the second end of the legs to the further formwork;

wherein the frame couples the first end of the legs together via the lateral supports; and wherein the formwork defines:

an external void space outside of the lateral supports and legs; and the internal void space located inside the hollow interior of the legs and the volume within the lateral supports, wherein the internal void space is continuous and not segmented and is configured to receive and retain concrete therein, wherein both the first and second ends of each leg are open and remain open in the concrete matrix, and wherein, when two formworks are vertically coupled, the hollow interiors of the coupled legs together with the vertical coupling define a continuous axial-flow passage aligned with the hollow interiors of the coupled legs and permitting concrete to flow from an upper formwork through the coupled legs into a lower formwork without any intervening plate, web, cross-bar, or closure.

19. The matrix of claim 18 configured for pouring of concrete therein, by:

selecting a plurality of formwork;

forming a first matrix layer by placing, on a substrate, the plurality of formwork, the plurality of formwork orientated in a configuration with the frame located below the second ends of the legs; and forming a second matrix layer, over the first matrix layer, by vertically coupling the second ends of the legs of each formwork in the second matrix layer to the second ends of the legs in the first matrix layer, the formwork of the second matrix layer orientated in a configuration with the frame located above the second ends of the legs, and pouring concrete into the second matrix layer such that the concrete flows axially through the continuous axial-flow passages defined by the coupled legs and vertical couplings into the first matrix layer.

20. The matrix as claimed in claim 19, wherein pouring concrete therein further comprises a coupling of the formwork of the first matrix layer, or the second matrix layer, or both the formwork of the first or the second matrix layer, together in a horizontal plane, while maintaining the continuous axial-flow passages between vertically coupled legs to permit unhindered axial flow of concrete between layers.

21. The matrix of claim 18 configured to be formed by:

selecting a plurality of formwork;

forming a first matrix layer by placing, on a substrate, the plurality of formwork, the plurality of formwork orientated in a configuration with the frame located below the second ends of the legs; and forming a second matrix layer, over the first matrix layer, by vertically coupling the second ends of the legs of each formwork in the second matrix layer to the second ends of the legs in the first matrix layer, the formwork of the second matrix layer orientated in a configuration with the frame located above the second ends of the legs; and pouring concrete into an internal volume of the plurality of formwork and allowing the poured concrete to cure and harden in the internal void space of the plurality of formwork, wherein both the first and second ends of every leg are open and remain open after vertical coupling, and wherein the vertical couplings between the second ends of the legs define continuous axial-flow passages aligned with the hollow interiors of the coupled legs to permit the concrete to flow axially from the second matrix layer through the coupled legs into the first matrix layer without any intervening plate, web, cross-bar, or closure.

22. A method of forming a concrete matrix, comprising:

attaching a formwork to a further formwork, wherein the formwork comprises:

a frame comprising lateral supports, each lateral support defining a volume within the lateral support, the volume defined by a base, sides and an at least partially open top;

at least four legs, each leg comprising:

a tapering wall structure defining a hollow interior;

a leg first end and a leg second end, both the leg first end and the leg second end opening to the hollow interior;

the leg first end having a first diameter opening tapering to a second diameter opening about the second end, the first diameter opening being larger than the second diameter opening;

the legs connected to the frame at the first end of each leg, the legs extending orthogonally away from the frame to the second ends of the legs;

the second end of the legs comprising a vertical coupling, the vertical coupling configured to couple with a further vertical coupling located on a second end of a leg of the further formwork, wherein the vertical coupling includes snap-fit retention elements disposed entirely within the hollow interiors at the second ends of the legs when coupled, the retention elements comprising elongated tabs that are radially resilient and configured to deflect inwardly during insertion and to expand outwardly to snap behind an internal annular shoulder of a mating leg, thereby locking the formworks together while maintaining a smooth interior face that is flush and uninterrupted over 360° within the legs, and wherein no intermediate socket, collar, or plate is interposed between the second ends of vertically coupled legs;

and, wherein the vertical coupling is configured to provide a smooth interior face between the second ends of the legs so as to facilitate concrete flow from one leg to a further leg, wherein the frame couples the first end of the legs together via the lateral supports, and wherein the formwork defines: an external void space outside of the lateral supports and legs, and an internal void space located inside the hollow interior of the legs and the volume within the lateral supports, wherein the internal void space is continuous and not segmented and is configured to receive and retain concrete therein; and filling an internal volume of the formwork with concrete and thereby causing the concrete to also fill an internal volume of the further framework via the second end of the legs and via the vertical coupling.

23. The method of claim 22, wherein the vertical coupling includes a retention feature configured to lock the formwork to the further formwork.

24. The method of claim 22, wherein the vertical coupling includes an elongated tab with a hook-shaped cross-section configured to engage the further formwork with a snap fit and to thereby secure the second end of the legs to the further formwork, the elongated tab being positioned entirely on an exterior surface of the tapering wall structure at the second end and configured to deflect during insertion and snap over a complementary external return shape of a mating leg while maintaining an uninterrupted smooth interior wall over 360° within the coupled legs and without any slot, groove, rib, or projection extending into the hollow interior.

25. The method of claim 22, wherein the vertical coupling includes a retention feature comprising an annular return lip moulded on an exterior perimeter of the second end of a leg and configured to lock the formwork to the further formwork.

26. The method of claim 22, wherein the elongated tab includes an outward barb configured to snap over an annular return lip of a mating leg so as to effect locking engagement while maintaining a smooth interior wall over 360° within the legs when coupled and without any slot, groove, rib, or projection extending into the hollow interior.

27. The method as claimed in claim 22, wherein the vertical coupling includes snap-fit retention elements disposed entirely within the hollow interiors at the second ends of the coupled legs, the retention elements comprising elongated tabs that are radially resilient and integrally molded in one piece with the tapering wall structure and configured to elastically deflect during insertion and to expand outwardly to snap behind an internal annular shoulder of a mating leg, thereby locking the formworks together while maintaining a smooth interior face that is flush over 360° within the coupled legs.

* * * * *